United States Patent [19]

Michel

[11] Patent Number: 5,020,639

[45] Date of Patent: Jun. 4, 1991

[54] METHOD OF, AND APPARATUS FOR, ABSORBING VIBRATIONS IN CARS OF HIGH-SPEED ELEVATORS

[75] Inventor: Aime Michel, Elancourt, France

[73] Assignee: Inventio AG, Hergiswil, Switzerland

[21] Appl. No.: 426,552

[22] Filed: Oct. 25, 1989

[30] Foreign Application Priority Data

Nov. 2, 1988 [CH] Switzerland ..... 04073/88

[51] Int. Cl.[5] ..... B66B 1/44

[52] U.S. Cl. ..... 187/1 R; 187/29.2; 187/110

[58] Field of Search ..... 187/1 R, 29.2, 110; 248/562, 581, 638

[56] References Cited

U.S. PATENT DOCUMENTS

| | | | |
|---|---|---|---|
| 1,669,184 | 5/1928 | Baker . | |
| 2,726,735 | 12/1955 | Rohrberg | 187/110 |
| 2,793,264 | 5/1957 | Jones et al. . | |
| 4,595,166 | 6/1986 | Kurokawa | 248/638 X |
| 4,660,682 | 4/1987 | Luinstra et al. . | |
| 4,709,787 | 12/1987 | Uchino | 187/1 R X |

FOREIGN PATENT DOCUMENTS 1407158 9/1975 United Kingdom .

*Primary Examiner*—H. Grant Skaggs

*Assistant Examiner*—Dean A. Reichard

*Attorney, Agent, or Firm*—Sandler, Greenblum & Bernstein

[57] ABSTRACT

The elevator car contains an elevator car body substantially horizontally supported at low friction at a support frame. The elevator car body is supported at a bottom yoke of the support frame by, for example, three hydraulic suspension units and is maintained in floating position during travel of the elevator car. During such travel, only the support frame carries out substantially horizontally directed thrust movements or vibrations which are generated by the associated guide rails, whereas the elevator car body remains in position or at rest due to its mass inertia and the low friction support. The floating elevator car body can be displaced into predeterminate positions by means of actuating cylinders. During travel of the elevator car, the floating elevator car body is displaced into a position spaced at a greater distance from the elevator shaft wall on the side of the elevator door for increasing the movement clearance. During approach to a destination floor or landing, the elevator car body is displaced into a position closer to the elevator shaft wall for reducing the entrance gap. The elevator car body is mechanically locked into a fixed position relative to the support frame prior to the mechanical coupling of the elevator door.

16 Claims, 4 Drawing Sheets

METHOD OF, AND APPARATUS FOR, ABSORBING VIBRATIONS IN CARS OF HIGH-SPEED ELEVATORS'

BACKGROUND OF THE INVENTION

The present invention relates to a new and improved method of, and apparatus for, supporting at low friction an elevator car or cabin body at a support frame of an elevator car or cabin.

In its more particular aspects, the present invention specifically relates to a new and improved method of, and apparatus for, supporting at low friction an elevator car or cabin body at a support frame of an elevator car or cabin and which method and apparatus are particularly suitable for absorbing vibrations which occur at the elevator cars or cabins in high-speed elevators. Such absorption of vibrations is effected by means of a substantially horizontal, low friction support of the elevator car or cabin body at the support frame.

Using present-day means and methods, the high requirements which are placed upon the travelling comfort of high-speed elevators, can be satisfied on the part of the elevator drive. However, with regard to the mounting precision which can be achieved at acceptable expenditure when mounting the guide rails for elevators operating in the velocity range of, for example, 5 m/s to 10 m/s, the requirements which are placed upon the travelling comfort of elevators of this class are no longer satisfied. The negative effects on the travelling comfort become manifest by troublesome horizontal shocks or vibrations which occur at the slightest local deviations of the guide rails and their connecting joints from the vertical. Additionally, the aforementioned mechanically caused negative effects on the travelling comfort become increasingly noticeable in a square relationship to an increase in the travelling speed of the elevator car or cabin.

It is generally known in the art to provide vibration damping elements of the most various types at different locations between the elevator car or cabin body and the support frame for solving the aforenoted problem. When using this type of vibration damping, a compromise must be made between rigid damping which negatively affects the travelling comfort, and non-rigid or yieldable damping which may cause excessive transverse deflection of the elevator car or cabin body and corresponding consequences.

In a lift or elevator car or cabin support system, such as known, for example, from U.S. Pat. No. 4,660,682, granted Apr. 28, 1987, a lower or bottom portion of the elevator car or cabin body is substantially horizontally moveably supported in all directions by guide means providing rolling or sliding support. An upper or top portion of the elevator car or cabin body is retained in a center position by means of damping elements arranged between the support frame and the elevator car or cabin body. The horizontal deflection of the lower or bottom portion of the elevator car or cabin body is effected against the forces of springs which center the elevator car or cabin body. In addition to the centering spring means, there are provided mechanical stop centering means containing an actuating cylinder and associated lever means.

The action of the mechanical centering means may transmit noise and blows or shocks to the elevator car or cabin body. The deflection of the lower or bottom portion of the elevator car or cabin body corresponds to a swivelling movement which implies that each point or location at the underside of the elevator car or cabin body moves along a circular line or arc about a center of rotation which is located at the top side of the elevator car or cabin body. This, in turn, has the consequence that particularly the outer points or locations at the underside of the elevator car or cabin body are subject to corresponding vertical movements. There thus result undesired effects like, for example, unilateral lifting or canting in view of the support which is rigid in vertical direction in the case of the aforementioned sliding or rolling support. Furthermore, this type of elevator car or cabin body support renders difficult the integration or incorporation of load measurements. The centering springs still transmit shocks or vibrations to the elevator car or cabin body and such elevator car or cabin body has relative restricted movement clearance.

SUMMARY OF THE INVENTION

Therefore with the foregoing in mind it is a primary object of the present invention to provide a new and improved method of, and apparatus for, supporting at low friction an elevator car or cabin body at a support frame of an elevator car or cabin and which method and apparatus are not afflicted with the drawbacks and limitations of the prior art constructions.

An important further object of the present invention is directed to a new and improved method of, and apparatus for, supporting at low friction an elevator car or cabin body at a support frame of an elevator car or cabin and which method and apparatus permit absorbing horizontal shocks substantially exclusively by the support frame during travel of the elevator car or cabin in a manner which is essentially unnoticeable by the elevator users or passengers.

It is still a further significant object of the present invention to provide a new and improved method of, and apparatus for, supporting at low friction an elevator car or cabin body at a support frame of an elevator car or cabin and which method and apparatus permit a small entrance gap and yet allow relatively wide deflections of the support frame relative to the elevator car or cabin body Another, still important object of the present invention is directed to a new and improved method of, and apparatus for, supporting at low friction an elevator car or cabin body at a support frame of an elevator car or cabin and which method and apparatus are quite reliable in operation and not readily subject to breakdown or failure.

Now in order to implement these and still further objects of the invention, which will become more readily apparent as the description proceeds, the method of the present development is manifested, among other things, by the features that, the elevator car or cabin body is floatingly supported at the support frame by means of at least one hydraulic suspension unit. The elevator car or cabin body thus assumes, by means of the hydraulic suspension units, a position which is isolated against substantially horizontal movements of the support frame which is subject to substantially horizontal jerk-like displacements or movements. The elevator car or cabin body may assume at least one predetermined horizontal position. A horizontal displacement of the elevator car or cabin body between or towards at least two horizontal positions can be effected at variable adjusting force by means of actuating cylinders.

During approach of the elevator car to a destination stop or target floor or landing, the elevator car or cabin body approaches a predetermined stop position at relatively closer spacing from the elevator shaft wall and ultimately is locked into the stop or fixed position at the support frame. In this stop or fixed position, the entrance gap is reduced to a dimension which is smaller than the usual dimension of such entrance gap.

During travel of the elevator car or cabin, the elevator car or cabin body assumes a predetermined travelling position at a relatively greater spacing from the elevator shaft wall on the side of the elevator door. Compensating or positioning forces are effective for counteracting substantially horizontal drift or displacements of the elevator car or cabin body relative to the support frame. The compensating or positioning forces vary as a function of the offset of the elevator car or cabin body from its travelling position.

As alluded to above, the invention is not only concerned with the aforementioned method aspects, but also relates to a novel construction of an apparatus for carrying out the same. Generally speaking, the inventive apparatus is an apparatus for supporting at low friction an elevator car body at a support frame of an elevator car or cabin.

To achieve the aforementioned measures, the inventive apparatus, in its more specific aspects, comprises:

an elevator car or cabin body having an underside;

a support frame having a bottom yoke;

at least one hydraulic suspension unit arranged between the bottom yoke of the support frame and the underside of the elevator car or cabin body; and a locking unit for rigidly connecting the elevator car or cabin body and the support frame in a predetermined stop or fixed position.

Essentially it is one of the advantages achieved by the invention that the substantially horizontal, low friction support of the elevator car or cabin body at the support frame permits rendering impossible the transmittal of horizontal impacts, shocks or vibrations from the support frame to the elevator car or cabin body. Thus the resulting relatively wide deflections or positional shifts of the elevator car or cabin body relative to the support frame permit the elevator system to be operated at very high travelling speeds. Still, during approach to a destination stop or floor or landing, suitable measures ensure precise and reliable coupling to the landing or hoistway door.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
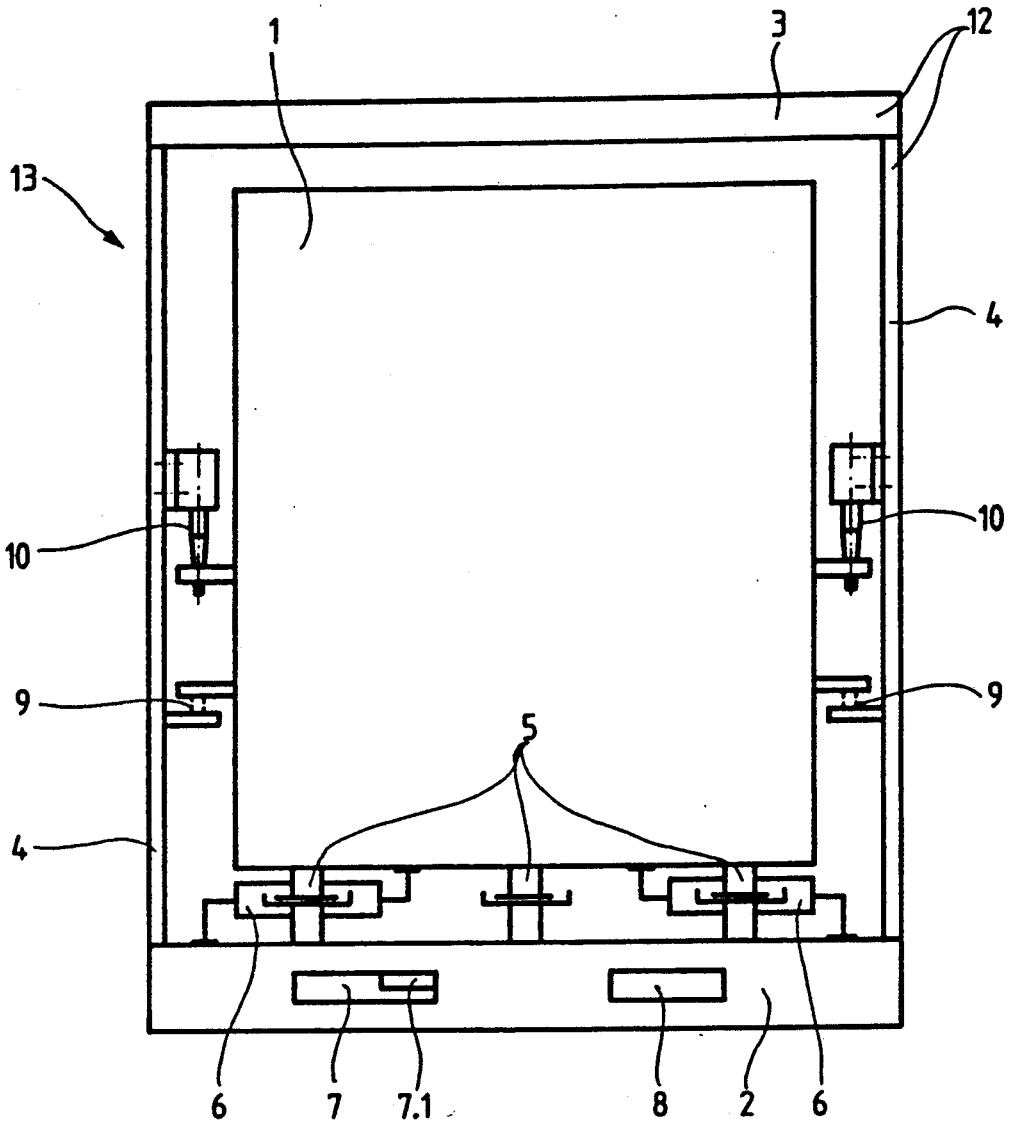
FIG. 1 is a total view of an exemplary embodiment of the inventive elevator car construction.

Describing now the drawings, it is to be understood that only enough of the construction of the elevator car has been shown as needed for those skilled in the art to readily understand the underlying principles and concepts of the present development, while simplifying the showing of the drawing. Turning now specifically to FIG. 1 of the drawings, there has been shown therein by way of example and not limitation a total view of the inventive elevator car or cabin 13 comprising an elevator car or cabin body 1 located within a support frame 12

The support frame 12 contains lateral uprights 4, a bottom yoke 2 and a crosshead 3. The elevator car or cabin body 1 bears upon three suspension units which can have any appropriate construction and constitute hydraulic suspension units 5 in the specifically illustrated example. Actuating cylinders 6 are rotatably mounted at one of their ends at the bottom yoke 2 and their other ends engage the underside of the elevator car or cabin body 1 at three respective locations. The actuating cylinders 6 serve to displace the elevator car or cabin body 1 between different predeterminate horizontal positions. In FIG. 1 only two of the three actuating cylinders 6 have been illustrated.

Position sensor means or transmitters 9 are located, as illustrated, between the elevator car or cabin body 1 and each one of the lateral uprights 4 of the support frame 12. Also, a mechanical locking unit 10 is placed laterally between the elevator car or cabin body 1 and each one of the lateral uprights 4. In the region of the bottom yoke 2 of the support frame 12, there is accommodated a hydraulic aggregate or power unit 7 which contains a control block 7.1, as well as an electric control unit 8

Figure 2:
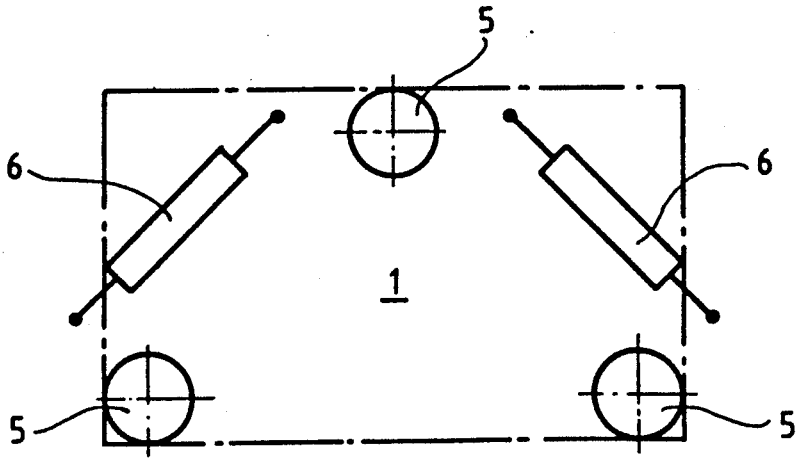
FIG. 2 is a top plan view of the elevator car construction illustrated in FIG. 1.

The geometrical arrangement of the hydraulic suspension units 5 and the actuating cylinders 6 will be apparent from FIG. 2. A total of three hydraulic suspension units 5 are provided and arranged in a triangular configuration. The lower side or region of the illustration in FIG. 2 containing two hydraulic suspension units 5, constitutes the entrance side of the elevator car or cabin body 1. The three actuating cylinders 6 are triangularly arranged for the purpose of governing substantially all of the substantially horizontal positioning directions.

Figure 3:
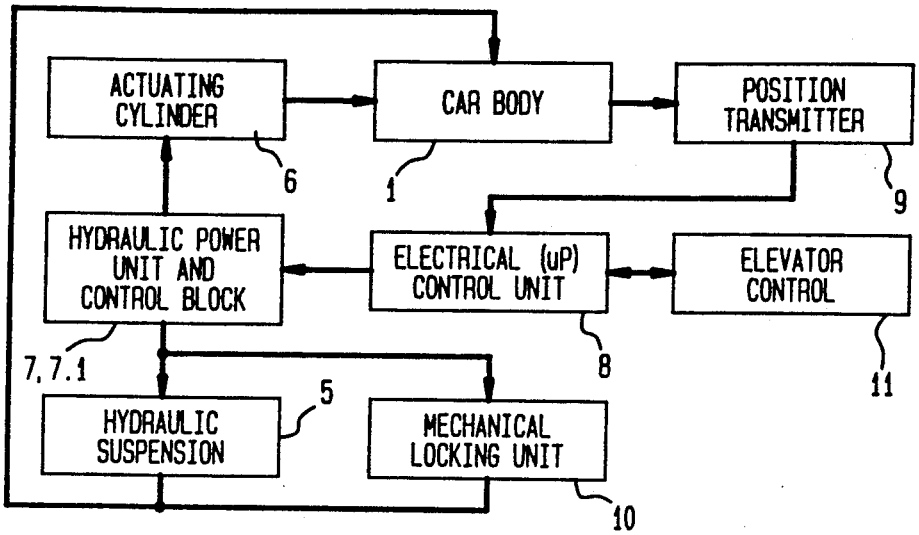
FIG. 3 is a block circuit diagram schematically illustrating the cooperation between the elevator car construction shown in FIG. 1 and a central elevator control.

The block circuit diagram shown in FIG. 3 illustrates the cooperation of the aforedescribed functional units 1 through 10 shown in FIG. 1 with a central elevator control designated by the reference character 11 and transmitting primary control signals for controlling the operation of such functional units 1 to 10.

The entire hydraulic system and its essential details will now be explained with reference to FIG. 4 of the drawings. A drive motor 7.3 drives a hydraulic pump 7.2 which operates at constant displacement volume and in a predetermined pumping or throughflow direction. An outlet pressure line 7.5 supplies the following functional units: the hydraulic suspension units 5, the actuating cylinders 6 and the mechanical locking units 10.

Figure 4:
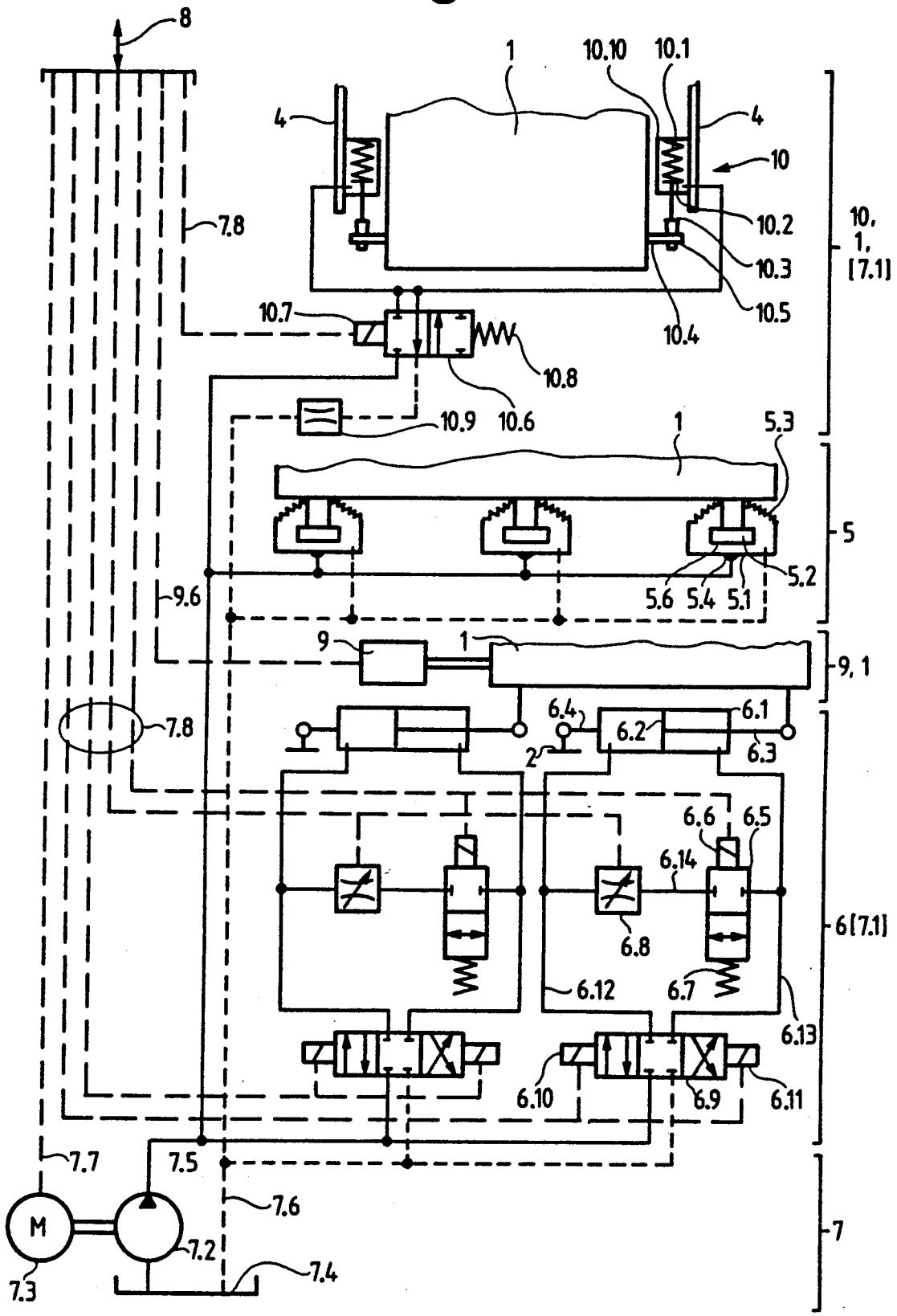
FIG. 4 is a schematic circuit diagram illustrating a hydraulic system in the elevator car construction shown in FIG. 1.

The control block 7.1 shown in FIG. 1 is broken up in FIG. 4 into control valves and throttles or restrictors which are functionally associated with individual ones of the aforementioned functional units 5, 6 and 10. The members of the control block 7.1 are a 4/3-way valve 6.9, a 2/2-way valve 6.5, a 4/2-way valve 10.6, an electrically controlled throttle or restrictor 6.8 and a fixed throttle or restrictor 10.9. Each one of the two 4/3-way valves 6.9 possess an actuating magnet 6.10 and an actuating magnet 6.11. The 4/3-way valves are illustrated in their stable inoperative positions which they assume under the action of not specifically illustrated return springs in the currentless state of the 4/3-way valves 6.9.

Each one of the two 2/2-way valves 6.5 possesses a return spring 6.7 and an actuating magnet 6.6. Each one of the two 4/2-way valves 10.6 contains a return spring 10.8 and an actuating magnet 10.7.

The actuating magnets 6.6, 6.10, only one of which is shown in the drawings, 6.11 and 10.7 as well as the electrically controlled throttles or restrictors 6.8 are each connected to an electric control line or conductor 7.8. An electrical supply line or conductor for the drive motor 7.3 is designated by the reference character 7.7.

A return line or conduit 7.6 conducts bleed and/or return oil from the aforementioned functional units back to a tank or reservoir 7.4.

The actuating cylinders 6 are designed as double-acting fluid-operated cylinders, for example, hydraulic cylinders. Each one of the actuating cylinders 6 contains a cylinder housing 6.1 which is provided with two connecting ports. The cylinder housing 6.1 is connected with the bottom yoke 2 of the support frame 12 by means of a joint 6.4. Each one of the actuating or double-acting hydraulic cylinders 6 further contains a piston 6.2 and a piston rod 6.3 which is articulatedly connected to the elevator car or cabin body 1. The third actuating cylinder 6 has not been illustrated in FIG. 4 in order to simplify the illustration of the hydraulic system.

Each one of the 4/3-way valves 6.9 is connected on its output side to the two connecting ports at the respective cylinder housing 6.1 by means of respective hydraulic lines or conduits 6.12 and 6.13. Transverse connections 6.14 are provided between the two hydraulic lines o conduits 6.12 and 6.13 of the respective cylinder housings 6.1 and respectively include the electrically controlled throttle or restrictors 6.8 and the 2/2-way valves 6.5.

Signal lines or conductors 9.6 which lead to the electrical control unit 8, are respectively connected to the position sensor means or transmitters 9 which indicate the momentary horizontal position of the elevator car or cabin body 1.

Each hydraulic suspension unit 5 which may also be described as a hydraulic slide cushion unit, comprises a horizontal slide plate 5.1 provided with a vertically extending rim portion, a slide shoe 5.2 and a dust-proof protective membrane 5.3. Each hydraulic suspension unit 5 defines a hydraulic suspension zone or oil cushion zone 5.6, an oil inlet opening 5.4 and an oil outlet opening 5.5. The slide shoes 5.2 are attached to the underside of the elevator car or cabin body 1.

Each one of the mechanical locking units 10 comprises a cylinder housing 10.10 which is mounted at the respective lateral upright 4, a compression spring 10.1, a piston 10.2 and a piston rod 10.3 which is, for example, substantially conically constructed at its lower end. This lower end of the piston rod 10.3 is immersed, in the fixed position of the elevator car or cabin body 1, into an appropriately shaped aperture 10.5 which is present in a lug 10.4 mounted at the elevator car or cabin body 1.

Figure 5:
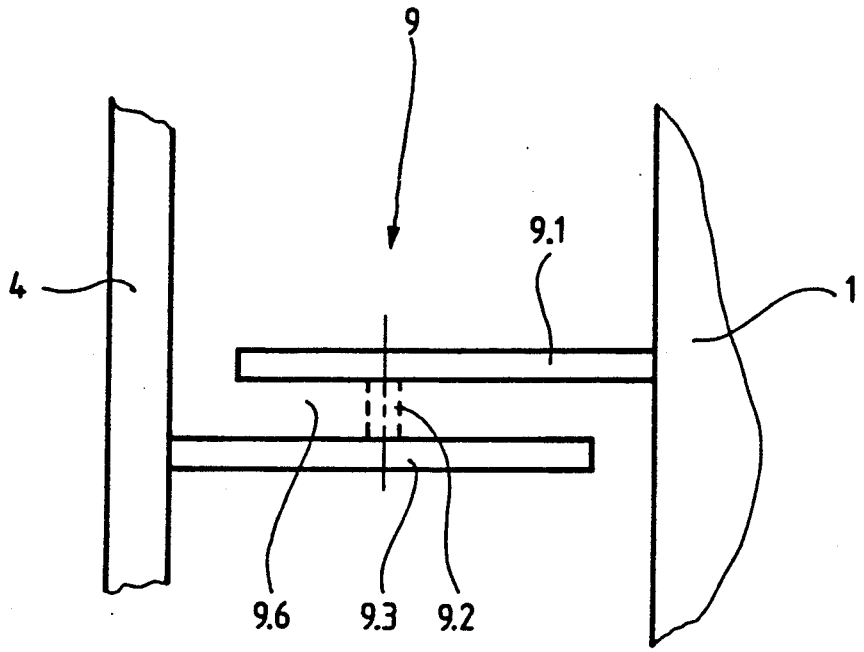
FIG. 5 is a schematic illustration of position sensor means provided in the elevator car construction shown in FIG. 1.

FIG. 5 shows a side view of one of the two substantially identically constructed position sensor means or transmitters 9 A transmitting component 9.1 thereof is connected, for example, to the elevator car or cabin body 1 and emits a light beam 9.2 through an intermediate space 9.6 to a light sensor plate 9 3 which is mounted, for example, at the lateral upright 4 of the support frame 12

Figure 6:
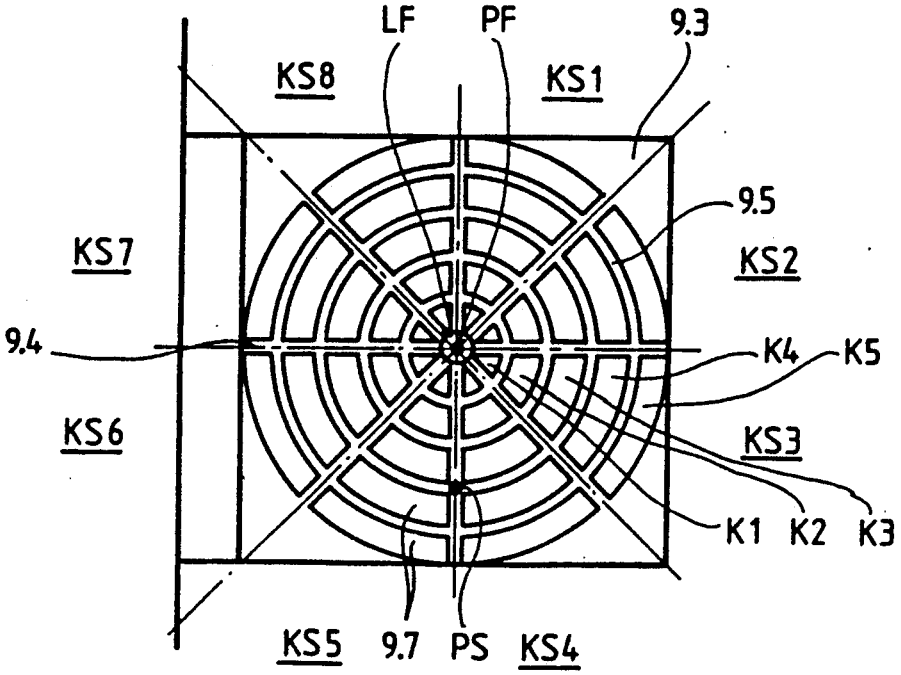
FIG. 6 is a top plan view of a sensor plate in the position sensor means shown in FIG. 5.

FIG. 6 shows an exemplary construction of the light sensor plate 9.3. The sensor area is subdivided into five substantially circularly shaped rings K1 to K5 which, in turn, are subdivided into eight substantially circular segments KS1 to KS8. A light spot LF is generated by the light beam 9.2 and has a diameter which has, for example, twice the size of the intermediate spaces which are present between the substantially circularly shaped rings K1 to K5 or the substantially circular segments KS1 to KS8. Two specifically marked positions or locations are respectively designated by the reference characters PS and PF and respectively associated with the predetermined stop position and the predetermined travelling position of the elevator car or cabin body 1. The individual substantially circular sensor segments are designated by the reference character 9.7.

Figure 8:
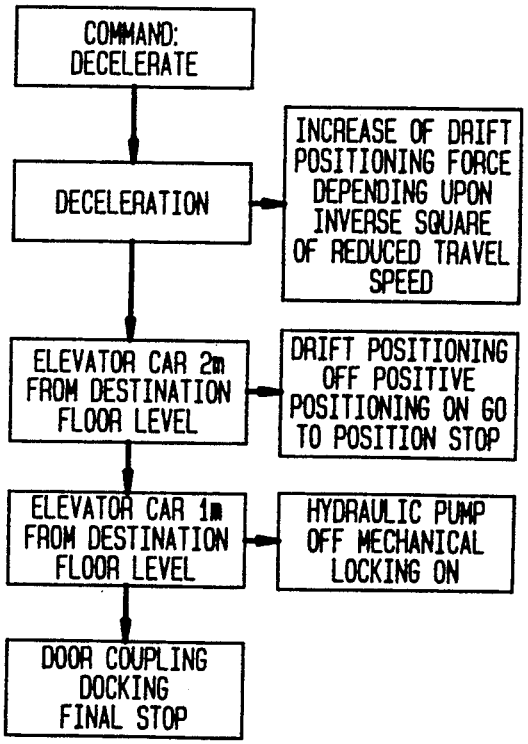
FIG. 8 is a block circuit diagram schematically illustrating the functional steps during approach of the inventive elevator car to a preselected destination.
Figure 7:
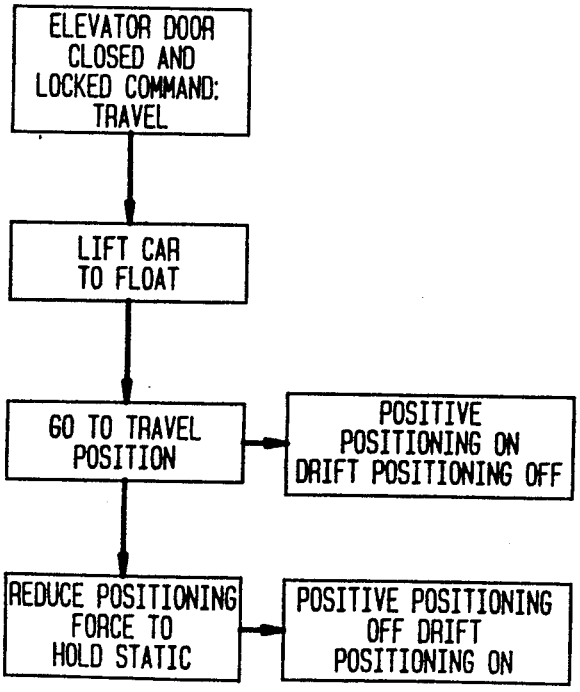
FIG. 7 is a block circuit diagram schematically illustrating the functional steps during departure of the inventive elevator car from a floor or landing.

Typical functions or processes which proceed in the inventive elevator car construction, are schematically illustrated as block circuit diagrams in FIGS. 7 and 8. The respective courses of events can be directly read from the individual blocks of the block circuit diagrams. In the following, the operations illustrated thereby will be explained in more detail.

The apparatus described hereinbefore with reference to FIGS. 1 to 6 of the drawings is constructed for carrying out the inventive method and operates as follows: Generally, the apparatus functions in accordance with the per se known principle of friction-free horizontal load movement by means of a hydraulic, pneumatic or magnetic cushion or suspension. In the illustrated exemplary embodiment of the inventive apparatus, the elevator car or cabin body 1 is supported at three hydraulic suspension units 5 which are arranged in triangular configuration within a substantially horizontal plane. Advantageously, three support points or locations are selected in order to obtain hydraulic cushion zones 5.6 of equal height, if possible, in all three hydraulic suspension units 5. Such hydraulic oil cushion is formed therein whenever hydraulic oil is pumped into the hydraulic oil cushion zone 5.6 located between the slide plate 5.1 and the slide shoe 5.2 through the inlet opening 5.4 under the action of the hydraulic pump 7.2 operating at constant displacement volume. In the supply lines or conduits leading to the inlet openings 5.4, not specifically illustrated volume controls or regulators provide substantially simultaneous and substantially uniform formation of the hydraulic oil cushions in all of the three hydraulic suspension units 5. The oil which is laterally forced out from the hydraulic oil cushion zone 5.6, flows back to the tank or reservoir 7.4 through the return line or conduit 7.6. The inner diameter or bore of the return flow system is dimensioned such that no back-up or dam-up of hydraulic oil develops within the slide plates 5.1.

When the hydraulic pump 7.2 is stopped by turning off the drive motor 7.3, the elevator car or cabin body 1 is immediately lowered and stands firmly with its slide shoes 5.2 at the respective slide plates 5.1. Advantageously the hydraulic pump 7.2 is constructed in the manner of a not too rapidly running multi-piston pump or gear pump.

When the hydraulic pump 7.2 is running, the hydraulic system pressure which is built up by, among others, the flow resistance caused by the formation of the hydraulic oil cushions within the hydraulic suspension units 5 and which prevails within the pressure line or conduit 7.5, is applied to the pistons 10.2 in the mechanical locking units 10. These pistons 10.2 are displaced against the force of the compression springs 10.1 to the upper stops in the cylinder housings 10.10 During such displacement, the conically structured ends of the piston rods 10.3 emerge from the respective apertures 10.5 in the respective lugs 10.4 and thus eliminate the mechanical fixation of the elevator car or cabin body 1 at the lateral uprights 4 of the support frame 12.

The functional units 5, 6, 7, 9 and 10 shown in FIG. 4 are operated under the control of the electrical control unit 8 which, in turn, processes control signals received from the central elevator control 11 as well as the position sensor means or transmitters 9. The essential elements of the electrical control unit 8 are a microprocessor system containing related control and regulating programs, an interface group for inputting and outputting signals and data, and amplifier stages for controlling the magnet coils or actuating magnets of the different valves and contactors.

During operation of the inventive apparatus, the central elevator control 11 transmits the command signals "travel" and "delay" and momentary values of the travelling speed. The electrical control unit 8 delivers signals representative of the status of the apparatus to the central elevator control 11. Such status signals contain data indicating whether the elevator car or cabin body 1 is mechanically locked or unlocked and a hydraulic oil cushion is or is not present within the hydraulic suspension units 5, as well as data which are precisely indicative of the momentary position of the elevator car or cabin body 1.

The precise instantaneous position of the elevator car or cabin body 1 is signalled by the two position sensor means or transmitters 9 which are attached to the respective sides of the elevator car or cabin body 1. The horizontal position of the elevator car or cabin body 1 is transmitted on two lateral sides of the elevator car or cabin body 1 to the respective light sensor plates 9.3 by means of the respective light beams 9.2. The projected light spot LF illuminates partial surface areas of one or more or a maximum of four of the substantially circular sensor segments 9.7. The partially illuminated substantially circular sensor segments 9.7 transmit corresponding active electrical signals to the electrical control unit 8. The address of the illuminated sensor segment 9.7 may be, for example, K3/KS3 and thus indicates that the illuminated segment 9.7 is constituted by the sensor segment 9.7 of the substantially circular ring K3 in the substantially circular segment KS3. In a further developed and not particularly illustrated construction, the sensor segments 9.7 are arranged in a matrix configuration.

As illustrated in FIG. 6, two position points or locations have been specifically marked. At the center, there is located the position marked PF which indicates the predetermined travelling position of the elevator car or cabin body 1. Further radially outwardly, for example, between the substantially circular rings K3 and K4 and the substantially circular segments KS4 and KS5, there is located the position marked PS indicating the predetermined stop position of the elevator car or cabin body 1. These two position points or locations PF and PS constitute reference locations and correspond to the two operation states or conditions of the elevator car or cabin 13, namely (i) the travelling state or condition and (ii) the standstill state or condition.

Regarding the standstill state or condition, the elevator car or cabin body 1 is positioned as closely as possible to the elevator shaft wall at a preselected floor or landing into the stop position PS. For the purpose of correct landing or hoistway door coupling and for providing a small entrance gap, the elevator car or cabin body 1 is mechanically locked into this stop position PS.

The elevator car or cabin body 1 assumes the travelling position PF during travel of the elevator car or cabin 13. In this position, the elevator car or cabin body 1 is spaced by a few centimeters from the elevator shaft installations on the side of the elevator door and thus has the required clearance for absorbing horizontal shocks or vibrations.

The active displacement of the elevator car or cabin body 1 into predeterminate horizontal positions relative to the support frame 12 is effected by means of the diagonally arranged actuating cylinders 6. These actuating cylinders 6 operate in two different modes of operation. A first mode of operation is called "positive positioning". During such positive positioning, the control valves 6.5 located in the transverse connections 6.14 remain in the closed positions as shown in FIG. 4. Consequently, the pistons 6.2 of the actuating cylinders 6 are positively displaced in correspondence with the adjustment of the respective control valves 6.9 and the magnitude of the volume flow in the individual supply lines or conduits. It is generally noted in this context that a horizontal displacement of the elevator car or cabin body 1 is effected only when the elevator car or cabin body 1 is floatingly supported at the support frame 12, i.e. when the hydraulic oil cushions are present within the hydraulic suspension units 5.

The second one of the aforementioned two different operating modes of the actuating cylinders 6 is called "drift positioning". During this mode of operation of the actuating cylinders 6, the respective control valves 6.5 are opened. Accordingly, and depending upon the adjustment of the electrically controlled throttles or restrictors 6.8, there is developed upon activation of the actuating cylinder 6 a corresponding parallel flow of hydraulic oil through the respective transverse connection 6.14. As a result, the adjusting force produced by the activating cylinder 6 is reduced to the required extent The drift positioning mode of operation achieves the object of maintaining the floatingly supported elevator car or cabin body 1 in the predetermined travelling position PF against substantially horizontally directed drift forces at a minimum adjusting force during travel of the elevator car or cabin 13. Horizontal shocks or vibrations are thus conducted or transmitted into the opened parallel hydraulic oil circuits formed by the transverse connections 6.14 by means of the so-to-speak freely running pistons 6.2. Such horizontal shocks or vibrations are no longer noticeable within the elevator car or cabin body 1 because there occurs merely a movement of the support frame 12 relative to the elevator car or cabin body 1.

In a further exemplary embodiment which is not specifically illustrated, the pistons 6.2 are provided with contactless labyrinth seals and the piston rod passages at the cylinder housings 6.1 are also provided with contactless labyrinth seals as well as antifriction bearings in order to avoid mechanical friction.

If there is signalled a remaining horizontal offset of the elevator car or cabin body 1 from the travelling position PF after a number of horizontal shocks or vibrations, the position of the elevator car or cabin body 1 is corrected so as to coincide with the predetermined travelling position PF at a slightly increased adjusting force of the actuating cylinders 6. This adjusting or displacing force is dependent upon the opening width of the respective electrically controlled throttles or restrictors 6.8. Independent of the momentary operating mode of the actuating cylinders 6, the displacement direction is determined by the adjustment of the 4/3-way control valves 6.9.

The momentary required adjustment range, adjustment force, adjustment direction and adjustment rate must be computed in the electrical control unit 8 from the combined signals originating at the position sensor means or transmitters 9. For example, the adjusting force and the adjusting rate may have a progressive characteristic depending upon the radial offset of the elevator car or cabin body 1 from the predetermined travelling position PF. It is intended to thereby prevent that, upon repeated impacts which displace the support frame 12 substantially in the same direction, the vertical rim of the slide plate 5.1 contacts the slide shoe 5.2. Additionally, the adjusting force is made to increase with the inverse square of the travelling speed during approach to a preselected destination or floor or landing in order to head towards the predetermined stop position PS during this phase of elevator car or cabin travel and to provide a gradual transition into the positive positioning mode of operation.

The positive positioning mode of operation serves for distinctly positioning and reliably maintaining the still floatingly supported elevator car or cabin body 1 in the predetermined stop position PS during approach to a preselected destination or floor or landing immediately prior to mechanically locking the elevator car or cabin body 1 in its fixed position at the support frame 12. The last mentioned mechanical locking operation is effected by means of the mechanical locking units 10 and occurs prior to the mechanical coupling of the elevator door with the floor or hoistway door.

During this locking operation the 4/2-way control valves 10.6 are placed into the position illustrated in FIG. 4 by turning off the actuating magnets 10.7. The compression springs 10.1, then, can urge the pistons 10.3 in a downward direction and the displaced oil flows through the fixed throttles or restrictors 10.9 and the return line or conduit 7.6 into the tank or reservoir 7.4. The conical ends of the piston rods 10.3 immerse into the respective apertures 10.5 in the respective lugs 10.4 at the elevator car or cabin body 1 and thereby immovably and fixedly hold the elevator car or cabin body 1 in the thus determined position, i.e. the predetermined stop position PS. When the mechanical locking becomes effective, the hydraulic pump 7.2 is turned off and the elevator car or cabin body 1 firmly stands with its slide shoes 5.2 at the slide plates 5.1 of the respective hydraulic suspension units 5 without the interposition of a hydraulic oil cushion. In this state or condition, the elevator car or cabin body 1 can absorb the forces produced by actuating the landing or hoistway doors and the elevator car or cabin doors without any change in its position. At the same time, when using this method, there is achieved an advantageous reduction in the entrance gap.

The chronological course of the aforedescribed individual functions during normal travel of the elevator car or cabin 13 is schematically illustrated by the block diagrams shown in FIGS. 7 and 8 of the drawings. The method and the apparatus for carrying out the same start operating at a moment of time at which the elevator door is closed and locked in the closed position and an active travel command is received from the central elevator control 11, see FIG. 7. By means of the running hydraulic pump 7.2, the elevator car or cabin body 1 is lifted to floating level due to the hydraulic oil cushions which are formed in the hydraulic suspension units 5, the pistons 10.3 of the mechanical locking units 10 are raised whereby the mechanical locking of the elevator car or cabin body 1 to the support frame 12 is eliminated, and the elevator car or cabin body 1 is positively positioned into the predetermined travelling position PF under the action of the actuating cylinders 6. Upon arrival at the predetermined travelling position PF and during the start phase of the elevator car or cabin travel, the actuating cylinders 6 are switched to the aforementioned drift positioning mode of operation. The transition from the positive positioning mode to the drift positioning mode of operation is effected in a smooth manner and already starts prior to the arrival of the elevator car or cabin body 1 at its predetermined travelling position PF. During actual travel of the elevator car or cabin 13, the inventive apparatus operates in the manner as described hereinbefore.

The next phase of the operation starts when there is received a decelerate command, as illustrated in FIG. 8. Such decelerate command has the consequence that the travel of the elevator car or cabin 13 is decelerated until standstill. With decreasing travelling speed, the adjusting force of the actuating cylinders 6 increases in inverse square relationship to the reduction in travelling speed which implies a gradual transition from the drift positioning mode to the positive positioning mode of operation. For example, at a distance of two meters from a preselected destination or floor or landing, there is effected the displacement of the elevator car or cabin body 1 from the travelling position PF to the stop position PS. Such displacement must be terminated, for example, at a distance of one meter from the preselected destination o floor or landing because the elevator car or cabin body 1 must be firmly positioned upon its base, i.e. at the slide plates 5.1 and mechanically fixed at the proper time prior to the coupling of the elevator car or cabin doors with the landing or hoistway doors 1. Such firm placement and mechanical fixation is effected by turning off the hydraulic pump 7.2, as already explained hereinbefore. The elevator car or cabin body 1 is retained in this stop position PS until commencement of the next-following elevator car or cabin travel The stop position PS must be assumed by the elevator car or cabin body 1 as late as possible in order for the elevator car or cabin body 1 to approach the elevator shaft wall as closely as possible for decreasing the entrance gap.

According to a further variant of the inventive method it is possible to totally eliminate the entrance gap during a third phase of the elevator operation. This is effected by newly raising the elevator car or cabin body 1 to floating level immediately upon standstill and at the open state or condition of the elevator door and by displacing the elevator car or cabin body 1 in exit direction until the entrance gap is eliminated at a third or further, not illustrated position point or location. This supplemental procedure has associated comfort advantages for rollingly loading the elevator car or cabin 13.

In a further development of the inventive construction, the supply lines or conduits leading from the pressure line or conduit 7.5 to the individual functional units in the hydraulic system illustrated in FIG. 4, partially contain not particularly illustrated pressure and volume regulating elements and/or check valves for optimizing the control function. In a further variant, separate hydraulic pumps 7 2 are provided and have operating characteristics which are specifically adapted to the individual functional units.

It is further possible to carry out the inventive method using a pneumatically operated apparatus or by employing different media, for example, hydraulic oil and air for the individual functional units in connection with the respectively required equipment.

Likewise, and in accordance with the principles of magnetic suspension, the inventive method and the inventive apparatus may rely upon magnetic suspension or magnetic cushions which may be constructed in the manner of mutually repelling electromagnets and/or permanent magnets. In this connection, a linear motor may be employed for substantially horizontally displacing the elevator car or cabin body 1.

The electric control of the hydraulic apparatus as shown in FIG. 4 may also be constructed on the basis of the equivalence analogy between electrical, hydraulic and fluid control operations.

It is further provided that an already existing hydraulic system can be retrofitted or supplemented with respect to the elevator car or cabin body suspension by adding a hydraulic follow-up regulating means or system for ensuring precise flush positioning of the elevator car or cabin 13 during load changes.

By measuring and evaluating the system pressure prevailing within the branch of the hydraulic suspension units 5, it is possible to obtain data indicating the load of the elevator car or cabin 13 whereby hydraulic load measurement can be realized.

Also, pressure accumulators may be employed and, as a result thereof, there can be used, for example, smaller hydraulic pumps or the hydraulic pumps can be run at lower rotary speeds for the purpose of noise reduction.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of supporting at low friction an elevator car body at a support frame of an elevator car, comprising the steps of:

floatingly supporting the elevator car body at the support frame during travel of the elevator car;

isolating the elevator car body which is floatingly supported at said support frame, against substantially horizontal movements carried out by said support frame relative to said elevator car body during said travel of said elevator car;

positioning said elevator car body relative to said support frame in at least two predeterminate substantially horizontal positions one of which is a travelling position assumed by said elevator car body during said travel of said elevator car, and another one of which is a stop position assumed by said elevator car body during a stop at a preselected destination of said elevator car;

said step of positioning said elevator car body in said stop position entailing, during approach of said elevator car to said preselected destination, the steps of displacing said elevator car body from said travelling position into said stop position close to a elevator shaft wall and ultimately locking said elevator car in said stop position at said support frame for providing a reduced entrance gap;

said step of positioning said elevator car body in said travelling position entailing, during departure of said elevator car from a predeterminate destination, the step of displacing said elevator car body relative to said support frame from said stop position into said travelling position and thereby providing a predetermined spacing of said elevator car body from said elevator shaft wall;

generating a variable adjusting force for positioning said elevator car body relative to said support frame in said at least two predeterminate positions;

during travel of said elevator car, counteracting and thereby compensating for substantially horizontal relative movements between said elevator car and said support frame by means of said variable adjusting force; and varying said variable adjusting force as a function of an offset of the elevator car body from said travelling position.

2. The method as defined in claim 1, wherein:

said steps of displacing said elevator car body relative to said support frame between said at least two predeterminate substantially horizontal positions and said steps of retaining said elevator car body in said travelling position relative to said support frame entail using a predeterminate number of fluid-operated actuating cylinders for displacing said elevator car body relative to said support frame between said at least two predeterminate substantially horizontal positions and for retaining said elevator car body in said travelling position relative to said support frame 3. The method as defined in claim 1, wherein said step of floatingly supporting said elevator car body at said support frame entails generating data indicative of the load carried by the elevator car body.

4. The method as defined in claim 1, further including the step of:

electro-hydraulically controlling said steps of displacing said elevator car body relative to said support frame between said at least two predeterminate substantially horizontal positions and generating said variable adjusting force on the basis of an equivalence analogy between electrical, hydraulic and fluid control operations.

5. The method as defined in claim 2, wherein:

said step of using said fluid-operated actuating cylinders entails using pneumatically operated actuating cylinders.

6. The method as defined in claim 1, wherein:

said step of floatingly supporting said elevator car body at said support frame entails using hydraulic suspension means for floatingly supporting said elevator car body at said support frame.

7. The method as defined in claim 1, wherein:

said step of floatingly supporting said elevator car body at said support frame entails using magnetic suspension means for floatingly supporting said elevator car body at said support frame.

8. The method as defined in claim 1, wherein:

during said step of positioning said elevator car body relative to said support frame between said at least two predeterminate substantially horizontal positions, varying the variable adjusting force acting between said elevator car body and said support frame; and varying said variable adjusting force as an inverse function of travelling speed of said elevator car.

9. A method of absorbing vibrations occurring between an elevator car body and its support frame of an elevator car in a high-speed elevator, comprising the steps of:

positioning the elevator car body in a substantially horizontal travelling position relative to the support frame during travel of the elevator car;

floatingly supporting the elevator car body in said substantially horizontal travelling position at said support frame by means of at least one suspension unit during said travel of said elevator car;

isolating the elevator car body, which is floatingly supported at said support frame, against substantially horizontal movements carried out by said support frame during said travel of the elevator car; and said step of isolating the elevator car body against said substantially horizontal movements carried out by said support frame entailing the step of generating an adjusting force counteracting and thereby compensating for relative horizontal displacements between said elevator car body and said support frame during said travel of the elevator car.

10. The method as defined in claim 9, wherein:

said step of generating said adjusting force entails generating a variable adjusting force; and varying said adjusting force as a function of an offset of said elevator car body from said substantially horizontal travelling position relative to said support frame.

11. An apparatus for supporting at low friction an elevator car body at a support frame of an elevator car, comprising:

support means for floatingly supporting the elevator car body at the support frame during travel of said elevator car;

said elevator car body assuming relative to said support frame at least two predeterminate substantially horizontal positions one of which is a travelling position in which said elevator car body is floatingly supported at said support frame during said travel of said elevator car, and another one of which is a stop position in which said elevator car is stopped at a preselected destination of said elevator car;

displacing means for substantially horizontally displacing said elevator car body relative to said support frame between said at least two predeterminate substantially horizontal positions;

adjusting means for generating a variable adjusting force at said displacing means;

said adjusting means generating, during said travel of said elevator car in said travelling position of said elevator car body, as said variable adjusting force, an adjusting force which counteracts and thereby compensates for substantially horizontal relative movements between said elevator car body and said support frame; and said adjusting means varying said variable adjusting force as a function of an offset of said elevator car body from said travelling position of said elevator car body relative to said support frame.

12. The apparatus as defined in claim 11, wherein:

said suspension means constitute hydraulic suspension means.

13. The apparatus as defined in claim 11, wherein:

said displacing means contain a predeterminate number of fluid-operated actuating cylinders.

14. The apparatus as defined in claim 13, further including:

a fluid pressure source;

each one of said predeterminate number of fluid-operated actuating cylinders constitutes a double-acting fluid-operated cylinder connected to said fluid pressure source; and said adjusting means constituting controlled adjusting means connected to said fluid pressure source in parallel to said predeterminate number of double-acting fluid-operated cylinders.

15. The apparatus as defined in claim 11, further including:

an electrical control unit;

position sensor means provided at said elevator car body and said support frame for sensing the position of said elevator car body relative to said support frame;

said position sensor means being connected to said electrical control unit;

said displacing means being connected to said electrical control unit;

said electrical control unit controlling said displacing means in response to an output signal received from said position sensor means and indicative of said position of said elevator car body relative to said support frame;

said adjusting means being connected to said electrical control unit; and said electrical control unit controlling the adjusting means in response to said output signal received from said position sensor means and indicative of said offset of said elevator car body from said travelling position of said elevator car body relative to said support frame.

16. The apparatus as defined in claim 15, further including:

a central elevator control connected to said electrical control unit;

said central elevator control supplying said electrical control unit with data indicative of the travelling speed of the elevator car;

said electrical control unit controlling said adjusting means for generating at said displacing means a variable adjusting force depending upon the travelling speed of said elevator car; and said adjusting means varying said variable adjusting force as an inverse function of travelling speed of said elevator car.

* * * * *